United States Patent [19]

Honda et al.

[11] Patent Number: 4,946,519

[45] Date of Patent: Aug. 7, 1990

[54] SEMI-PROCESSED NON-ORIENTED ELECTROMAGNETIC STEEL STRIP HAVING LOW CORE LOSS AND HIGH MAGNETIC PERMEABILITY, AND METHOD OF MAKING

[75] Inventors: Atsuhito Honda, Chiba; Michiro Komatsubara, Kurashiki; Ko Matsumura, Chiba; Keiji Nishimura, Chiba, all of Japan

[73] Assignee: Kawasaki Steel Corporation, Japan

[21] Appl. No.: 207,198

[22] Filed: Jun. 16, 1988

[30] Foreign Application Priority Data

Jun. 18, 1987 [JP] Japan ..... 62-150208

[51] Int. Cl.[5] ..... H01F 1/147

[52] U.S. Cl. ..... 148/307; 148/310; 420/92; 420/103; 420/117; 420/119; 420/120

[58] Field of Search ..... 148/307, 308, 310; 420/119, 92, 103, 117, 120

[56] References Cited

U.S. PATENT DOCUMENTS

| | | | |
|---|---|---|---|
| 3,873,380 | 3/1975 | Malargari | 148/111 |
| 3,940,299 | 2/1976 | Goto et al. | 148/111 |
| 4,046,602 | 9/1977 | Stanley | 148/111 |
| 4,204,890 | 5/1980 | Irie et al. | 148/111 |
| 4,529,453 | 7/1985 | Rastogi et al. | 148/307 |
| 4,615,750 | 10/1986 | Mochinaga et al. | 148/111 |
| 4,772,341 | 9/1988 | Rastogi et al. | 148/307 |

FOREIGN PATENT DOCUMENTS

| | | | |
|---|---|---|---|
| 49-38814 | 8/1974 | Japan . | |
| 51-74923 | 6/1976 | Japan . | |
| 56-9356 | 1/1981 | Japan | 420/103 |
| 56-34616 | 8/1981 | Japan . | |
| 57-35628 | 2/1982 | Japan . | |
| 61-67753 | 4/1986 | Japan . | |

*Primary Examiner*—John P. Sheehan

*Attorney, Agent, or Firm*—Oliff & Berridge

[57] ABSTRACT

A semi-processed non-oriented electromagnetic steel strip having low core loss and high magnetic permeability is provided which consists essentially of, in % by weight, up to 0.02% of C, 0.2 to 2.0% of Si, 0.1 to 0.6% of Al, 0.02 to 0.10% of P, 0.5 to 1.5% of Mn, 0.1 to 1.0% of Ni, and optionally up to 0.6% of Cu, and optionally 0.01 to 0.2% of Sb and/or Sn, and a balance of iron and inevitable impurities. Magnetic properties are further improved when it is manufactured by hot rolling a slab having the composition at a temperature of from 1,100° to 1,200° C., completing hot finish rolling at a temperature of at least 700° C. in the austenite region, annealing the strip at a temperature from 800° to 880° C. for at least one hour, cold rolling and annealing the strip, and optionally, skin pass rolling with a reduction of 2 to 12%.

9 Claims, 2 Drawing Sheets

SEMI-PROCESSED NON-ORIENTED ELECTROMAGNETIC STEEL STRIP HAVING LOW CORE LOSS AND HIGH MAGNETIC PERMEABILITY, AND METHOD OF MAKING

BACKGROUND OF THE INVENTION

1. Field of the Invention

This invention relates to semi-processed non-oriented electromagnetic steel strips having a low core loss and a high magnetic permeability.

2. Prior Art

It is a common practice to lower the core loss of electromagnetic steel strip by adding silicon (Si) and aluminum (Al) to the steel composition to increase the resistivity and reduce the eddy current loss thereof. Addition of these elements is effective in lowering the core loss, but undesirably results in a reduced magnetic permeability.

Japanese Patent Publication No. 56-34616 proposes the addition of manganese (Mn) instead of Si and Al. The addition of manganese is effective in increasing resistivity while reducing magnetic permeability to a relatively less extent. However, magnetic permeability is reduced with the addition of manganese although it is a relatively small reduction.

Japanese Patent Application Kokai No. 61-67753 proposes to reduce the core loss of electric steel by adding copper (Cu) to modify its aggregate texture. With this method, however, magnetic permeability is more or less reduced. Since copper has a low melting point, there remains a risk that hot brittle cracking would occur during hot rollding.

A variety of methods have been employed to manufacture electrical steel having improved magnetic properties. With respect to a hot rolling step, Japanese Patent Application Kokai No. 51-74923 proposes a method for manufacturing an electrical steel strip having improved magnetic properties and a minimized variation in thickness by completing hot rolling at as high a temperature in the ferrite region as possible. Japanese Patent Application Kokai No. 57-35628 proposes to complete hot rolling at a temperature in the austenite region and carry out annealing at a temperature in the ferrite region for 30 seconds to 15 minutes for the purpose of increasing the grain size before cold rolling to eventually improve magnetic properties. Further, Japanese Patent Application Kokai No. 49-38814 discloses that magnetic properties are improved by heating a slab at a temperature of lower than 1,200° C. to precipitate coarse grains of AlN to promote the growth of grains.

However, there is available no adequate composition or manufacturing method which is successful in reducing core loss and increasing magnetic permeability.

SUMMARY OF THE INVENTION

An object of the present invention is to provide an electromagnetic steel strip having a low core loss and a high magnetic permeability.

Another object of the present invention is to provide a method for making such a steel strip.

We have found that a steel composition having specific contents of Si, Mn and Al can provide improved core loss and magnetic permeability by adding a proper amount of Ni thereto to develop (100), (110) and other aggregate texture favorable for magnetic properties while suppressing (111) aggregate texture deleterious to magnetic properties. The present invention is based on this finding.

According to a first aspect of the present invention, there is provided a semi-processed non-oriented electromagnetic steel strip having a low core loss and a high magnetic permeability, the steel having a composition consisting essentially of, in % by weight, C: up to 0.02%,
Si: 0.2 to 2.0%,
Al: 0.1 to 0.6%,
P: 0.02 to 0.10%,
Mn: 0.5 to 1.5%,
Ni: 0.1 to 1.0%, and a balance of iron and inevitable impurities. Optionally, the composition may further contain up to 0.6% by weight of Cu and/or 0.01 to 0.2% by weight of one or both of Sb and Sn. The presence of incidental impurities is contemplated.

According to a second aspect of the present invention, there is provided a process for preparing a semi-processed non-oriented electromagnetic steel strip having a low core loss and a high magnetic permeability, comprising the steps of:

heating a slab having the above-defined composition to a temperature in the range of from 1,100° to 1,200° C., completing hot finish rolling of the slab into a strip at a temperature of at least 700° C. in the austenite region, taking up the strip in coil form, annealing the strip at a temperature in the range of from 800° to 880° C. for at least one hour, cold rolling and annealing the strip, and skin pass rolling the strip with a reduction of 2 to 12%.

The last-mentioned skin pass rolling may be omitted. A semi-processed electromagnetic steel strip having high magnetic permeability is obtained by the above method without skin pass rolling as long as the steel composition falls within the above-defined range. Although a low core loss is not expectable, the strip is useful in some applications.

According to a third aspect of the present invention, there is provided a process for preparing a semi-process non-oriented electromagnetic steel strip having a low core loss and a high magnetic permeability, comprising the steps of:

hot rolling a slab having the same composition as defined above, but further containing 0.0005 to 0.0040% by weight of B into a strip, taking up the strip in coil form, annealing the strip at a temperature of at least 800° C. in the austenite region for at least one minute, cold rolling and annealing the strip, and skin pass rolling the strip with a reduction of 2 to 12%.

BRIEF DESCRIPTION OF THE DRAWINGS

The above and other objects, features, and advantages of the present invention will be more fully understood from the following description taken in conjunction with the accompanying drawings, in which.

DESCRIPTION OF THE INVENTION

The present invention is described in detail on the basis of the experimental results. The reason of limiting the composition and manufacturing steps will become apparent from the following description. All percents are by weight unless otherwise stated.

Figure 1:
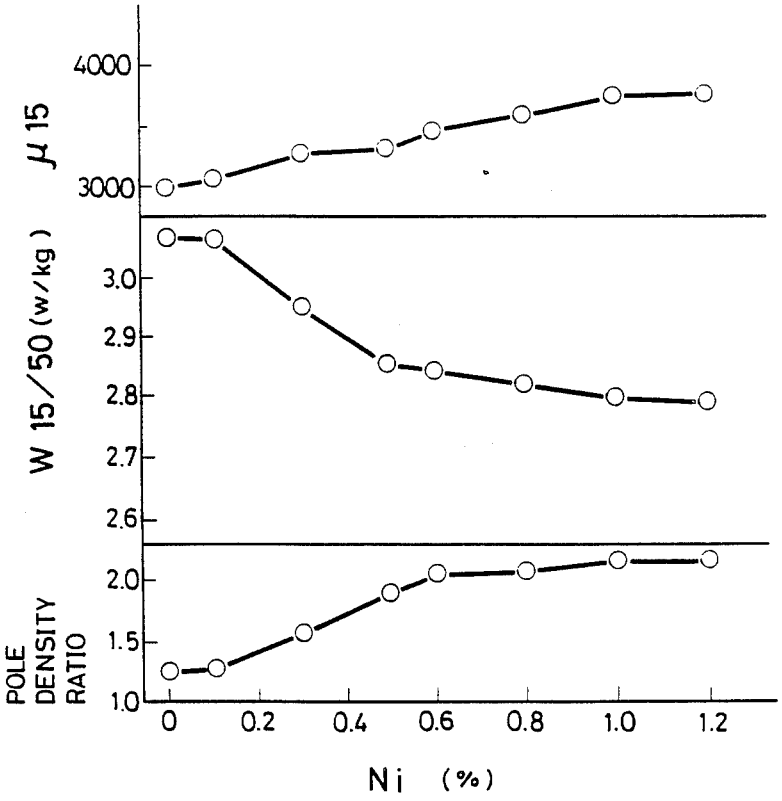
FIG. 1 is a diagram showing the magnetic permeability, core loss and pole density ratio of a steel composition as a function of the amount of Ni added.

Steel strips were prepared by starting with a steel slab having a composition consisting of 0.003% of C, 0.57% of Si, 0.03% of P, 0.23% of Al and 1.20% of Mn, an amount of Ni varying from 0% to 1.2% and a balance of iron and incidental impurities, hot rolling the slab into a strip, annealing the strip at 860° C. for 5 hours, cold rolling the strip to a thickness of 0.54 mm, continuously annealing at a temperature of 800° C. for 1 minute, and skin pass rolling to a thickness of 0.50 mm. The resulting steel strips were shear cut to the Epstain size and annealed at 750° C. for 2 hours in a nitrogen atmosphere for strain removal. They were examined for magnetic properties, that is, core loss (W15/50 expressed in w/kg) and magnetic permeability ($\mu$1.5), and aggregate texture. The results are shown in FIG. 1. The pole density ratio is the sum of pole densities of magnetically advantageous (100) and (110) structures divided by the sum of pole densities of magnetically disadvantageous (111) and (112) structures. The higher the pole density ratio, the better the aggregate texture is. As seen from FIG. 1, the addition of Ni improves aggregate texture, resulting in a reduced core loss and an increased magnetic permeability.

We have applied a variety of manufacturing methods including prior art methods to steel having the composition defined by the present invention to find that the steel having the composition of the invention always exhibits improved magnetic properties irrespective of a particular manufacturing method employed.

Continuing our study, we have found that magnetic properties are drastically improved when hot rolling is completed in the austenite phase and the hot-rolled strip is annealed in the ferrite region. There are obtained some products having poor surface conditions. The reason is that grains can grow extremely large during annealing of hot-rolled strip. We have found that such inconvenience can be avoided by properly controlling the hot rolling step to lower the slab heating temperature, which is required to complete hot rolling in the austenite phase region, to below the conventionally necessary temperature. In addition, excellent properties are achieved by controlling the hot rolling step as above.

Figure 2:
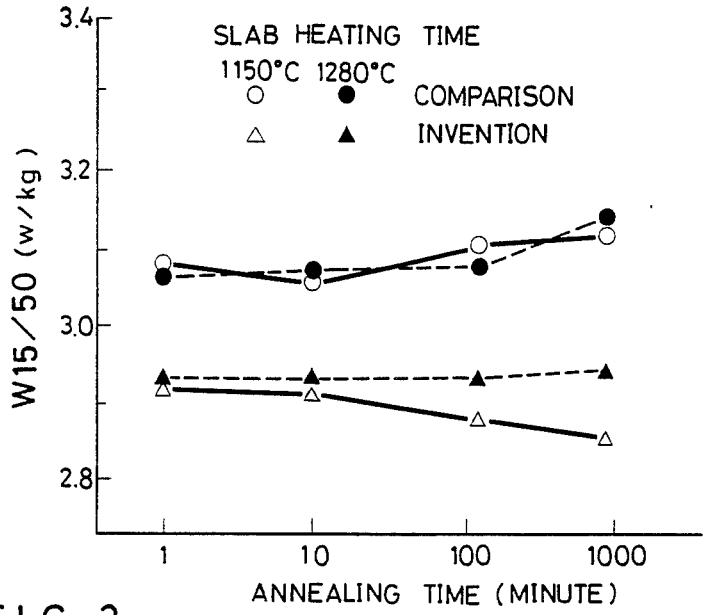
FIG. 2 is a diagram showing the core loss of both Ni-added and Ni-free steel compositions as a function of annealing time.

FIG. 2 is a diagram showing the core loss of present and comparative steel strips as a function of annealing time. The comparative steel slab had a composition consisting of 0.003% of C, 0.57% of Si, 0.23% of Al, 1.2% of Mn, 0.03% of P, and a balance of iron and incidental impurities. The present steel slab had the same composition as above except that it further contained 0.5% of Ni. Steel products were prepared by heating slabs at different temperatures of 1150° C. and 1280° C., completing hot finish rolling at a temperature of 890° C. which is in the austenite region, taking up the strip in coil form, and annealing the strip at a temperature of 800° C. which is in the ferrite region for different times of 1, 10, 100 and 1,000 minutes, followed by cold rolling, annealing, skin pass rolling with a reduction of 6% into a strip of 0.50 mm thick, and annealing for strain removal.

As is evident from FIG. 2, when the starting steel slab has a composition within the scope of the present invention, an electromagnetic steel strip having excellent surface conditions and a drastically improved core loss can be obtained by heating the slab at a lower temperature, completing hot rolling at a temperature in the austenite region, and annealing at a temperature in the ferrite region for a longer period of time. In order that a steel strip having a composition within the scope of the present invention exhibit improved magnetic properties, as opposed to the conventional steel composition, it is necessary, after finish rolling is completed at a temperature in the austenite region, to anneal a hot-rolled strip at a temperature in the ferrite region for an extended period of time in excess of one hour because annealing for a shorter time of 30 seconds to 15 minutes as proposed in Japanese Patent Application Kokai No. 57-35628 is not effective in improving magnetic properties. Another difference is recognized in slab heating. No beneficial effect is observed with the conventional steel when the slab heating temperature is lowered, but finish rolling is completed at a temperature in the austenite region. A great beneficial effect is achieved with the present steel by a combination of slab heating at a lower temperature of 1,100° to 1,200° C., completion of hot rolling at a temperature in the austenite region, and annealing of hot-rolled strip for a longer time.

It has been found for steel compositions having both Ni and B added that annealing of hot-rolled strips at a temperature of at least 800° C. in the austenite region is significantly effective in improving magnetic properties. Such high-temperature annealing is believed unfavorable in the prior art because the aggregate texture is deteriorated to adversely affect magnetic properties. It has also been found that such high-temperature annealing can eliminate surface defects which are sometimes observed in conventional steel strips obtained by annealing hot-rolled strips at a temperature in the ferrite region.

Figure 3:
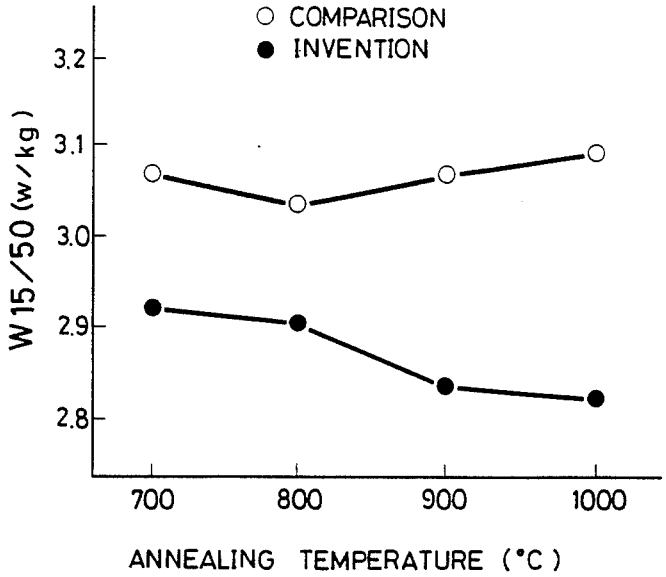
FIG. 3 is a diagram showing the core loss of both B-added and B-free steel compositions as a function of annealing temperature.

FIG. 3 is a diagram showing the core loss of present and comparative steel strips as a function of annealing temperature. The comparative steel slab had a composition consisting of 0.003% of C, 0.57% of Si, 0.23% of Al, 1.2% of Mn, 0.03% of P, and a balance of iron and incidental impurities. The present steel slab had the same composition as above except that it further contained 0.5% of Ni and 0.0015% of B. Steel products were prepared by hot rolling slabs and annealing the strips at different temperatures of 750° C., 850° C., 950° C. and 1,050° C. for 5 minutes, followed by cold rolling, annealing, skin pass rolling with a reduction of 6% into a strip of 0.50 mm thick, and annealing for strain removal.

It was found that the comparative and present steel strips had been transformed into austenite phase by annealing at 950° C. As is evident from FIG. 3, electromagnetic steel strips having a significantly improved core loss can be obtained from the present steel composition by annealing hot-rolled strips at a temperature of at least 800° C. in the austenite region. No defects were observed on the surface of the present steel strips.

The percent reduction of skin pass rolling is limited to the range of from 2 to 12% according to the present invention. Skin pass rolling with a reduction of less than 2% inhibits grain growth, resulting in an increased iron loss. With a reduction of more than 12%, the aggregate texture is deteriorated to lower magnetic permeability.

The foregoing description is based on the results of experiments using a specific steel composition. We have made a series of experiments with varying steel compositions to find the same tendency as long as the compositions fall within the scope of the present invention.

Next, the reason for limiting the content of the respective elements will be described. All percents are by weight.

C: up to 0.02%

Carbon is deleterious to magnetic properties because it forms carbides to adversely affect core loss and magnetic permeability. The content of carbon is thus limited to 0.02% or lower.

Si: 0.2–2.0%

At least 0.2% of silicon is necessary in order that silicon be effective in lowering core loss whereas inclusion of more than 2.0% of silicon adversely affects magnetic permeability. The content of silicon is thus limited to the range of from 0.2 to 2.0%.

Al: 0.1–0.6%

Aluminum is also necessary to lower core loss as silicon is. Inclusion of at least 0.1% of aluminum will be effective whereas more than 0.6% of aluminum adversely affects magnetic permeability. The content of aluminum is thus limited to the range of from 0.1 to 0.6%.

P: 0.02–0.10%

At least 0.02% of phosphorus is necessary in order that phosphorus be effective in lowering core loss whereas inclusion of more than 0.10% of phosphorus adversely affects magnetic permeability. The content of phosphorus is thus limited to the range of from 0.02 to 0.10%.

Mn: 0.5–1.5%

Manganese is necessary to increase resistivity as silicon and aluminum are. The presence of at least 0.5% of manganese will be effective in improving aggregate texture if nickel is added. More than 1.5% of manganese adversely affects magnetic permeability. The content of manganese is thus limited to the range of from 0.5 to 1.5%.

Ni: 0.1–1.0%

Nickel, an ingredient characteristic of the present invention, assists in development of an aggregate texuture useful for magnetic properties. Less than 0.1% of nickel is not effective. More than 1.0% of nickel will provide no additional improvement in core loss and magnetic permeability irrespective of a cost increase. The content of nickel is thus limited to the range of from 0.1 to 1.0%.

Cu: up to 0.6%

Copper may be added because it increases resistivity and lowers eddy current loss. More than 0.6% of copper addversely affects magnetic permeability. A problem of hot brittle cracking will occur when copper is added alone. Hot brittle cracking is negligible insofar as at least 0.1% of nickel is contained because nickel compensates for a lowering of melting temperature by copper.

Sb and/or Sn: 0.01–0.2%

Either or both of antimony and tin may be added because they are effective in preventing surface oxidation and nitridation. Less than 0.01% is not effective whereas more than 0.2% adversely affects magnetic properties. The content of antimony or tin or antimony plus tin is thus limited to the range of from 0.01 to 0.2%.

B: 0.0005–0.0040%

Steel having nickel and boron added in combination exhibits improved magnetic properties and surface conditions when it is annealed at a temperature of at least 800° C. in the austenite region. Less than 0.0005% of boron is not effective whereas more than 0.0040% adversely affects magnetic properties. The content of boron is thus limited to the range of from 0.0005 to 0.0040%.

EXAMPLES

Examples of the present invention are given below by way of illustration and not by way of limitation. All percents are by weight.

EXAMPLE 1

Steel materials on test had the composition shown in Table 1.

Steel strips were prepared by hot rolling slabs having the composition shown in Table 1 and annealing the hot-rolled strips under varying conditions. Annealing of hot-rolled strips was followed by cold rolling to a thickness of 0.54 mm, intermediate annealing at 750° C. for 1 minute in a nitrogen atmosphere, and skin pass rolling to a thickness of 0.50 mm. An Epstain test piece was punched from the resulting strip and annealed for strain removal before its magnetic properties were determined. The core loss (W15/50 expressed in w/kg) and magnetic permeability ($\mu$1.5) are reported in Table 2 together with processing conditions.

As is evident from Table 2, the core loss and magnetic permeability of steel are improved as long as the steel has a composition within the scope of the present invention. When the steel having a composition within the scope of the present invention is processed according to the method of the present invention, further improved properties are obtained.

TABLE 1

| | Composition | | | | | | | | | |
|---|---|---|---|---|---|---|---|---|---|---|
| No. | C | Si | Mn | P | Al | Ni | Cu | Sb | Sn | B |
| C1 | 0.004 | 0.51 | 1.05 | 0.05 | 0.22 | 0.03 | — | — | — | — |
| C2 | 0.003 | 0.55 | 1.20 | 0.05 | 0.21 | 0.30 | — | — | — | — |
| C3 | 0.003 | 0.58 | 0.45 | 0.05 | 0.23 | 0.34 | — | — | — | — |
| C4 | 0.003 | 0.50 | 1.05 | 0.05 | 0.25 | 0.30 | 0.33 | — | — | — |
| C5 | 0.004 | 0.55 | 1.10 | 0.05 | 0.25 | 0.42 | — | 0.05 | — | — |
| C6 | 0.003 | 0.52 | 1.20 | 0.05 | 0.28 | 0.58 | 0.09 | — | 0.08 | — |
| C7 | 0.003 | 0.50 | 1.15 | 0.05 | 0.25 | 0.28 | 0.25 | 0.03 | 0.06 | — |
| C8 | 0.004 | 0.51 | 1.20 | 0.05 | 0.26 | 0.35 | 0.29 | 0.05 | 0.05 | 0.0015 |
| C9 | 0.005 | 0.52 | 0.82 | 0.05 | 0.21 | 0.95 | — | 0.05 | — | — |

TABLE 2

| Sample No. | Composition | Slab heating temp. (°C.) | Finish rolling temp. (°C.) | Hot-rolled strip annealing Temp (°C.) | × | Time (hr.) | W15/50 (w/kg) | μ1.5 | Remarks Composition | Method |
|---|---|---|---|---|---|---|---|---|---|---|
| 1 | C1 | 1250 | 850* | 840 | | 5 | 3.17 | 2450 | comparison | — |
| 2 | C1 | 1300 | 890 | 840 | | 5 | 3.15 | 2280 | comparison | — |
| 3 | C1 | 1150 | 780* | 840 | | 5 | 3.13 | 2310 | comparison | — |
| 4 | C1 | 1180 | 900 | 840 | | 5 | 3.16 | 2380 | comparison | — |
| 5 | C1 | 1180 | 900 | 840 | | 5 | 3.39 | 3640 | comparison | no skin pass |
| 6 | C2 | 1180 | 880 | 840 | | 5 | 2.85 | 3150 | invention | invention |
| 7 | C2 | 1180 | 880 | 840 | | 5 | 3.15 | 5560 | invention | no skin pass |
| 8 | C3 | 1180 | 885 | 840 | | 5 | 3.15 | 2720 | comparison | — |
| 9 | C4 | 1180 | 860 | 840 | | 5 | 2.60 | 3580 | invention | invention |
| 10 | C5 | 1180 | 870 | 840 | | 5 | 2.63 | 3890 | invention | invention |
| 11 | C6 | 1300 | 880 | 840 | | 5 | 2.75 | 3450 | invention | comparison |
| 12 | C6 | 1150 | 720* | 840 | | 5 | 2.79 | 3390 | invention | comparison |
| 13 | C6 | 1180 | 830 | 840 | | 0.5 | 2.70 | 3620 | invention | comparison |
| 14 | C6 | 1180 | 810 | 780 | | 5 | 2.89 | 3150 | invention | comparison |
| 15 | C6 | 1180 | 800 | 840 | | 5 | 2.52 | 3710 | invention | invention |
| 16 | C7 | 1180 | 830 | 840 | | 5 | 2.60 | 3750 | invention | invention |
| 17 | C7 | 1180 | 830 | 980 | | 0.1 | 3.00 | 2910 | invention | comparison |
| 18 | C8 | 1180 | 830 | 980 | | 0.1 | 2.65 | 3590 | invention | invention |
| 19 | C8 | 1250 | 860 | 980 | | 0.1 | 2.58 | 3680 | invention | invention |
| 20 | C9 | 1280 | 870 | 840 | | 5 | 2.82 | 3520 | invention | comparison |
| 21 | C9 | 1150 | 700* | 840 | | 5 | 2.76 | 3690 | invention | comparison |
| 22 | C9 | 1180 | 800 | 840 | | 0.5 | 2.84 | 3310 | invention | comparison |
| 23 | C9 | 1180 | 800 | 750 | | 5 | 2.77 | 3380 | invention | comparison |
| 24 | C9 | 1180 | 800 | 840 | | 5 | 2.49 | 3890 | invention | invention |

*shows completion of rolling in the ferrite region.

The semi-processed non-oriented electromagnetic steel strip of the present invention is particularly useful as core material for motors of medium to small size and transformers. Because of low core loss and high magnetic permeability, the strip will meet the demand for energy saving. The strip is usually supplied to the user such that the user will carry out punching and strain-removing annealing before the strip is assembled as a core.

Although preferred embodiments of the present invention are described, obviously numerous modifications and variations of the present invention are possible in light of the above teachings. It is therefore to be understood that within the scope of the appended claims, the invention may be practiced otherwise than as specifically described herein.

We claim:

1. A semi-processed non-oriented electromagnetic steel strip having a low core loss and a high magnetic permeability, said strip consisting essentially of, in % by weight, C: up to 0.02%,
Si: 0.2 to 2.0%,
Al: 0.21 to 0.6%,
P: 0.02 to 0.10%,
Mn: 0.5 to 1.5%,
Ni: 0.1 to 1.0%, and a balance of iron and inevitable impurities.

2. A semi-processed non-oriented electromagnetic steel strip having a low core loss and a high magnetic permeability, said strip consisting essentially of, in % by weight, C: up to 0.02%,
Si: 0.2 to 2.0%,
Al: 0.21 to 0.6%,
P: 0.02 to 0.10%,
Mn: 0.5 to 1.5%,
Ni: 0.1 to 1.0%,
Cu: up to 0.6%, and a balance of iron and inevitable impurities.

3. A semi-processed non-oriented electromagnetic steel strip having a low core loss and a high magnetic permeability, said strip consisting essentially of, in % by weight, C: up to 0.02%,
Si: 0.2 to 2.0%,
Al: 0.1 to 0.6%,
P: 0.02 to 0.10%,
Mn: 0.5 to 1.5%,
Ni: 0.1 to 1.0%, one or both of Sb and Sn: 0.01 to 0.2%, and a balance of iron and inevitable impurities.

4. A semi-processed non-oriented electromagnetic steel strip having a low core loss and a high magnetic permeability, said strip consisting essentially of, in % by weight, C: up to 0.02%,
Si: 0.2 to 2.0%,
Al: 0.1 to 0.6%,
P: 0.02 to 0.10%,
Mn: 0.5 to 1.5%,
Ni: 0.1 to 1.0%,
Cu: up to 0.6%, one or both of Sb and Sn: 0.01 to 0.2%, and a balance of iron and inevitable impurities.

5. A semi-processed non-oriented electromagnetic steel strip as recited in claim 1, wherein nickel is present in an amount sufficient to improve magnetic properties of said strip.

6. A semi-process non-oriented electromagnetic steel strip as recited in claim 2, wherein nickel is present in an amount sufficient to improve magnetic properties of said strip.

7. A semi-processed non-oriented electromagnetic steel strip as recited in claim 3, wherein nickel is present in an amount sufficient to improve magnetic properties of said strip.

8. A semi-processed non-oriented electromagnetic steel strip as recited in claim 4, wherein nickel is present in an amount sufficient to improve magnetic properties of said strip.

9. A semi-processed non-oriented electromagnetic steel strip as recited in claim 1, wherein nickel is present in an amount greater than 0.1% by weight.

* * * * *